US007074750B2

(12) United States Patent
Hamers et al.

(10) Patent No.: US 7,074,750 B2
(45) Date of Patent: Jul. 11, 2006

(54) TREATMENT METHOD, WHICH PROMOTES THE REMOVAL OF DIRT, FOR THE SURFACES OF TEXTILES AND NON-TEXTILES

(75) Inventors: Christoph Hamers, Ludwigshafen (DE); Dieter Boeckh, Limburgerhof (DE); Kati Schmidt, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 179 days.

(21) Appl. No.: 10/479,983

(22) PCT Filed: Jun. 14, 2002

(86) PCT No.: PCT/EP02/06628

§ 371 (c)(1),
(2), (4) Date: Dec. 15, 2003

(87) PCT Pub. No.: WO02/103105

PCT Pub. Date: Dec. 27, 2002

(65) Prior Publication Data

US 2004/0171515 A1 Sep. 2, 2004

(30) Foreign Application Priority Data

Jun. 15, 2001 (DE) ..... 101 28 894

(51) Int. Cl.
*C11D 3/37* (2006.01)

(52) U.S. Cl. ..... 510/400; 510/276; 510/361; 510/398; 510/434; 510/477; 510/528; 510/533

(58) Field of Classification Search ..... 510/276, 510/361, 398, 400, 434, 477, 528, 533
See application file for complete search history.

(56) References Cited

U.S. PATENT DOCUMENTS 3,580,653 A 5/1971 Parran, Jr.
3,580,853 A * 5/1971 Parran ..... 510/382
3,782,898 A 1/1974 Mandell, Jr.
3,993,830 A * 11/1976 Dickson et al. ..... 442/93
2003/0171246 A1 9/2003 Boeckh et al.
2003/0195135 A1 10/2003 Boeckh et al.
2004/0077517 A1 4/2004 Boeckh et al.

FOREIGN PATENT DOCUMENTS

EP 0 692 566 1/1996
WO 98 13453 4/1998

* cited by examiner

*Primary Examiner*—Charles Boyer
(74) *Attorney, Agent, or Firm*—Oblon, Spivak, McClelland, Maier & Neustadt, P.C.

(57) ABSTRACT

A process for the soil release treatment of surfaces of textile and nontextile materials, in which cationically modified hydrophilic nanoparticles based on crosslinked polymers of (a) 60 to 99.99% by weight of one or more carboxyl-containing ethylenically unsaturated monomers or salts thereof, (b) 0 to 40% by weight of one or more water-insoluble monoethylenically unsaturated monomers, (c) 0.01 to 30% by weight of one or more polyethylenically unsaturated monomers, (d) 0 to 25% by weight of one or more sulfonic acid- and/or phosphonic acid-containing monomers or salts thereof, (e) 0 to 30% by weight of one or more water-soluble nonionic monomers are applied to the surface of the materials from an aqueous dispersion, where the dispersion of the hydrophilic nanoparticles can be stabilized with anionic, nonionic and/or betainic emulsifiers and/or protective colloids, and where the hydrophilic nanoparticles have a particle size of from 10 nm to 2 μm and have been cationically modified by coating their surface with one or more cationic polymers, one or more polyvalent metal ions and/or one or more cationic surfactants.

16 Claims, No Drawings

TREATMENT METHOD, WHICH PROMOTES THE REMOVAL OF DIRT, FOR THE SURFACES OF TEXTILES AND NON-TEXTILES

The invention relates to a process for the soil release treatment of surfaces of textile and nontextile materials using cationically modified hydrophilic nanoparticles, to the cationically modified hydrophilic nanoparticles themselves, to aqueous dispersions comprising said particles, to the use of the hydrophilic nanoparticles and to the cationically modified hydrophilic nanoparticles as soil release additive to rinse, care, washing and cleaning compositions, and to compositions for the soil release treatment of surfaces.

Dispersions of particles of hydrophobic polymers, in particular aqueous dispersions of synthetic polymers and of waxes are used in the art in order to modify the properties of surfaces. For example, aqueous dispersions of finely divided hydrophobic polymers are used as binders in paper coating slips for the coating of paper, or as coating compositions. The dispersions applied in each case to a substrate in accordance with customary methods, e.g. by knife coating, painting, immersion or impregnation, are dried. During this, the dispersely distributed particles form a continuous film on the respective surface.

In contrast, aqueous washing, rinse, cleaning and care processes are usually carried out in a heavily diluted liquor, where the ingredients of the formulation used in each case for the most part do not remain on the substrate, but instead are disposed of with the wastewater. The modification of surfaces with dispersed hydrophobic particles is possible in the abovementioned processes only to an entirely unsatisfactory degree. Thus, for example, U.S. Pat. No. 3,580,853 discloses a laundry detergent formulation which comprises a water-insoluble finely divided substance, such as biocides and certain cationic polymers, which U.S. Pat. No. 3,993,830 discloses the application of a nonpermanent soil repellent finish on a textile ware by treating the textile ware with a dilute aqueous solution which comprises a polycarboxylate and a water-soluble salt of a polyvalent metal. Suitable polycarboxylates are, preferably, water-soluble copolymers of ethylenically unsaturated monocarboxylic acids and alkyl acrylates. The mixtures are used in domestic textile washing in the rinse cycle of the washing machine.

U.S. Pat. No. 3,782,898 discloses the application of a nonpermanent soil repellent finish to a textile ware by treating the textile ware with an acidic dilute aqueous solution which comprises an acrylate polymer in dissolved or emulsified form. The specification gives no information regarding an advantageous use of particulate polymers and, in particular, no information regarding an advantageous combination of particulate polymers with cationic substances.

It is an object of the present invention to provide an improved process for the soil release modification of textile surfaces, leather, hard smooth surfaces and hard porous surfaces.

We have found that this object is achieved according to the invention by a process for the soil release treatment of surfaces of textile and nontextile materials, in which cationically modified hydrophilic nanoparticles based on crosslinked polymers of (a) 60 to 99.99% by weight of one or more carboxyl-containing ethylenically unsaturated monomers or salts thereof, (b) 0 to 40% by weight of one or more water-insoluble monoethylenically unsaturated monomers, (c) 0.01 to 30% by weight of one or more polyethylenically unsaturated monomers, (d) 0 to 25% by weight of one or more sulfonic acid- and/or phosphonic acid-containing monomers or salts thereof, (e) 0 to 30% by weight of one or more water-soluble nonionic monomers are applied to the surface of the materials from an aqueous dispersion, where the dispersion of the hydrophilic nanoparticles can be stabilized with anionic, nonionic and/or betainic emulsifiers and/or protective colloids, and where the hydrophilic nanoparticles have a particle size of from 10 nm to 2 μm and have been cationically modified by coating their surface with one or more cationic polymers, one or more polyvalent metal ions and/or one or more cationic surfactants.

We have found that this object is further achieved by the use of the hydrophilic nanoparticles and the cationically modified hydrophilic nanoparticles, and the aqueous dispersions comprising the hydrophilic or cationically modified hydrophilic nanoparticles as soil release additive to rinse, care, washing and cleaning compositions.

The invention also provides the cationically modified hydrophilic nanoparticles themselves, and the aqueous dispersions comprising said particles.

For the purposes of the present invention, hydrophilic nanoparticles are hydrophilic polymer particles of crosslinked polymers or particulate hydrogels of crosslinked polymers whose particle size is 10 nm to 2 μm and which can be bonded to the surface to be modified by means of cationic components. Particulate hydrogels is the term used to refer to polymer particles highly swollen with water, the acid groups of the polymer particles optionally being partially neutralized with water-soluble bases such as LiOH, NaOH, KOH or ammonium hydroxides. Suitable cationic components are cationic polymers, polyvalent metal cations or cationic surfactants. Cationically modified hydrophilic nanoparticles for the purposes of the invention have a coating on their surface with one or more of said cationic components.

The hydrophilic nanoparticles to be used according to the invention are obtained in the preparation firstly in the form of aqueous dispersions and can, optionally after concentration or dilution, be used as such. The hydrophilic nanoparticles can, after spray drying, also be obtained and used as a solid. From the aqueous dispersions of the hydrophilic nanoparticles, it is possible to obtain aqueous dispersions of the cationically modified hydrophilic nanoparticles by adding the cationic components, and to use them as such, or, after spray drying, the cationically modified hydrophilic nanoparticles can be obtained and used as a solid. The cationically modified hydrophilic nanoparticles can also be formed only under the conditions of use in an aqueous rinse, care, washing and cleaning liquor.

The cationically modified hydrophilic nanoparticles are obtainable, for example, by mixing aqueous dispersions of the hydrophilic nanoparticles with an aqueous solution or dispersion of the cationic polymers, of the polyvalent metal cations in the form of their soluble salts or the cationic surfactants. The cationic component is preferably used in the form of aqueous solutions, but it is also possible to use aqueous dispersions of the cationic polymers whose dispersed particles have an average diameter up to 2 μm. The two components are usually mixed at room temperature, although mixing can also be carried out at temperatures of, for example, 0° to 100° C., provided that the dispersions do not coagulate upon heating. The hydrophilic nanoparticles to be used according to the invention are insoluble in water at the application pH. In the aqueous dispersion, they are in the form of particles or particulate hydrogels with an average particle size of from 10 nm to 2 μm, preferably 25 nm to 1 μm, particularly preferably 40 nm to 800 nm and in particular 100 to 600 nm, and can be obtained from the aqueous dispersions as powders. The average particle size of the nanoparticles can be determined, for example, under the electron microscope or using light scattering experiments.

The pH of the aqueous dispersions of the hydrophilic nanoparticles is, for example, 1 to 11and is preferably in the range from 1.5 to 8, particularly preferably in the range from 2 to 6.5, in particular in the range from 2.5 to 4.5.

The hydrophilic nanoparticles to be used according to the invention usually exhibit a pH-dependent solubility and swelling behavior. The swelling behavior is dependent on the monomer composition, the degree of crosslinking, the average molecular weight of the polymers and the temperature. At a pH below 11, preferably below 8, particularly preferably below 6.5 and in particular below 4.5, the particles arc water-insoluble and retain their particulate character or particulate hydrogel character upon dispersion in concentrated and in dilute aqueous media. By contrast, the hydrophilic nanoparticles used according to the invention swell greatly, or partially or completely dissolve in water under neutral, in particular under alkaline, conditions.

Nanoparticles used according to the invention contain crosslinked polymers of (a) 60 to 99.9% by weight, preferably 70 to 99% by weight, particularly preferably 75 to 95% by weight, of one or more carboxyl-containing ethylenically unsaturated monomers or salts thereof, (b) 0 to 40% by weight, preferably 1 to 30% by weight, particularly preferably 5 to 25% by weight, of one or more water-insoluble monoethylenically unsaturated monomers, (c) 0.01 to 30% of one or more polyethylenically unsaturated monomers, (d) 0 to 25% by weight, preferably 0 to 15% by weight, particularly preferably 0.1 to 5% by weight, of one or more sulfonic acid- and/or phosphonic acid-containing monomers of salts thereof, (e) 0 to 30% by weight, preferably 0 to 20% by weight, particularly preferably 0 to 10% by weight, of one or more water-soluble nonionic monomers.

Preferred carboxyl-containing ethylenically unsaturated monomers a) are α,β-unsaturated $C_3$–$C_6$-carboxylic acids, such as acrylic acid, methacrylic acid, ethacrylic acid, crotonic acid, vinylacetic acid, itaconic acid, maleic acid, itaconic monoesters of $C_1$–$C_6$-alcohols, maleic acid or maleic monoesters of $C_1$–$C_6$-alcohols. Particular preference is given to acrylic acid, methacrylic acid, maleic acid or maleic monoesters of $C_1$–$C_6$-alcohols. Special preference is given to methacrylic acid.

Water-insoluble monomers b) are all monomers which are soluble in water at room temperature in an amount of less than 50 g/l. These are monomers from the group of the alkyl esters of monoethylenically unsaturated $C_3$–$C_6$-carboxylic acids and monohydric $C_1$–$C_{22}$-alcohols, hydroxyalkyl esters of monoethylenically unsaturated $C_3$–$C_5$-carboxylic acids and dihydric $C_2$–$C_4$-alcohols, vinyl esters of saturated $C_1$–$C_{18}$-carboxylic acids, ethylene, propylene, isobutylene, $C_4$–$C_{24}$-alpha-olefins, butadiene, styrene, alpha-methylstyrene, acrylonitrile, methacrylonitrile, tetrafluoroethylene, vinylidene fluoride, fluoroethylene, chlorotrifluoroethylene, hexafluoropropene, esters and amides of $C_3$–$C_5$-monoethylenically unsaturated carboxylic acids with perfluoroalkyl-containing alcohols or amines, allyl and vinyl esters of perfluoroalkyl-containing carboxylic acids, or mixtures thereof. Higher proportions of water-insoluble monomers b) are preferably present in the polymers if very polar monomers a), such as acrylic acid, itaconic acid and maleic acid, or monomers d) or e) are present in the polymer in a relatively large amount, for example in an amount above 10% by weight, in particular above 20% by weight.

Preferred water-insoluble monomers b) are acrylonitrile, methyl acrylate, ethyl acrylate, n-butyl acrylate, sec-butyl acrylate, tert-butyl acrylate, ethylhexyl acrylate, hydroxyethyl acrylate, hydroxypropyl acrylate, methyl methacrylate, n-butyl methacrylate, (meth)acrylate of perfluoroalkyl-substituted alcohols $CF_3$—$(C_2F_4)_n$—$(CH_2)_m$—OH or $C_2F_5$—$(C_2F_4)_n$—$(CH_2)_m$—OH where n=2–8, m=1 or 2, vinyl acetate, vinyl propionate, styrene, ethylene, propylene, butylene, isobutene, diisobutene and tetrafluoroethylene, and particularly preferred water-insoluble monomers b) are methyl acrylate, methyl methacrylate, ethyl acrylate, n-butyl acrylate, tert-butyl acrylate and vinyl acetate.

Suitable polyethylenically unsaturated monomers c) are, for example, acrylic esters, methacrylic esters, allyl ethers or vinyl ethers of at least dihydric alcohols. The OH groups of the parent alcohols can be completely or partially etherified or esterified; however, the crosslinkers contain at least two ethylenically unsaturated groups, Examples are glycol diacrylate, glycol dimethacrylate, butanediol diacrylate, hexanediol diacrylate, trimethylolpropane triacrylate and tripropylene glycol diacrylate. Further suitable polyethylenically unsaturated monomers c) are, for example, allylesters of unsaturated 5 carboxylic acids, divinylbenzene, metylenebisacrylamide and divinylurea. Preferred ethylenically unsaturated monomers c) are allyl methacrylate, diacrylates and dimethacrylates of $C_2$–$C_6$-diols and di-, tri- and tetraalkylene glycols having $C_2$–$C_4$-alkylene units.

Suitable sulfonic acid- or phosphonic acid-containing monomers d) are, for example, acrylamido-2-methylpropanesulfonic acid, vinylsulfonic acid, methallylsulfonic acid, vinylphosphonic acid, and the alkali metal and ammonium salts of these monomers.

Suitable water-soluble monomers e) have a solubility of at least 50 g/l of water at room temperature. Suitable monomers e) are, for example, acrylamide, methacrylamide, N-vinylformamide, N-vinylacetamide, N-vinylpyrrolidone, N-vinyloxazolidone, methyl polyglycol acrylate, methyl polyglycol methacrylate and methyl polyglycol acrylamide. Preferred monomers e) are vinylpyrrolidone, acrylamide and N-vinylformamide.

A characteristic feature of the crosslinked polymers present in the nanoparticles is their particulate, i.e. undissolved, character under the conditions of use. This particulate character is given at a pH below 11, preferably below 8, particularly preferably below 6.5 and especially below 4.5 for most of the compositions. In cases where the proportions of readily water-soluble monomers a), d) or e) are high, it may be necessary to further reduce the pH during use, e.g. below 3 or below 2, in order to ensure the particulate character. In the case of very small particles in the range from 10–100 nm, it may only be possible to detect the particles in some circumstances using specific techniques, such as electron microscopy.

Crosslinked polymers of the monomers a), c) and optionally b), d) and/or e) can be prepared by the known processes of solution polymerization, precipitation polymerization, suspension polymerization or emulsion polymerization, and inverse emulsion polymerization or inverse microemulsion polymerization of the monomers using free-radical polymerization initiators. The hydrophilic nanoparticles are preferably obtained by the process of emulsion polymerization in water. In cases where the proportions of hydrophilic monomers a), d) and e) are high, the polymerization can also be carried out in reverse suspension or emulsion.

To limit the molar masses of the polymers, it is possible to add customary regulators during the polymerization. Examples of typical regulators are mercapto compounds, such as mercapto ethanol or thioglycolic acid.

Suitable polymerization triggers are polymerization initiators which decompose either thermally or photochemically, form free radicals and thus trigger polymerization. Here, of the thermally activatable polymerization initiators, preference is given to those which decompose between 20 and 180° C., in particular between 50 and 90° C.

Particularly preferred polymerization initiators are peroxides, such as dibenzoyl peroxide, di-tert-butyl peroxide, peresters, percarbonates, perketals, hydroperoxides, and also inorganic peroxides, such as $H_2O_2$, salts of peroxosulfuric acid and peroxodisulfuric acid, azo compounds, boron-alkyl compounds and hydrocarbons which decompose homolytically.

The polymers have molar masses of at least 5 000, preferably at least 25 000, in particular at least 50 000.

Apart from said polymerization processes, other processes for the preparation of the hydrophilic nanoparticles are also suitable. Thus, for example, it is possible to precipitate out polymers by lowering the solubility of the polymers in the solvent. Such a method consists, for example, in dissolving an acidic group-containing polymer in a suitable watermiscible solvent, and metering in water in an excess such that the pH of the initial charge is lower by at least 1 than the equivalent pH of the polymers. Equivalent pH is understood as meaning the pH at which 50% of the acid groups of the polymer have been neutralized. In this process, it may be necessary to add a dispersion auxiliary, pH regulators and/or salts in order to obtain stable finely divided dispersions.

The aqueous dispersions of the hydrophilic nanoparticles can be stabilized with anionic, nonionic or betainic emulsifiers and/or protective colloids. The emulsifiers and protective colloids may be present as dispersion auxiliaries during the preparation of the nanoparticles, or can be added subsequently.

Examples of anionic emulsifiers are anionic surfactants and soaps. Anionic surfactants which may be used are alkyl and alkenyl sulfates, sulfonates, phosphates and phosphonates, alkyl- and alkenylbenzenesulfonates, alkyl ether sulfates and phosphates, saturated and unsaturated $C_{10}$–$C_{25}$-carboxylic acids and salts thereof.

Nonionic and/or betainic emulsifiers can also be used. A description of suitable emulsifiers is given, for example, in Houben Weyl, Methoden der organic Chemie [Methods of organic chemistry], volume XIV/1, Makromolekulare Stoffe [Macromolecular substances], Georg Thieme Verlag, Stuttgart, 1961, pages 192 to 208.

Examples of anionic protective colloids are water-soluble anionic polymers. In this connection, it is possible to use very different types of polymer. Anionically substituted polysaccharides and/or water-soluble anionic copolymers of acrylic acid, methacrylic acid, maleic acid, maleic monoesters, vinylsulfonic acid, styrenesulfonic acid or acrylamidopropanesulfonic acid with other vinylic monomers are preferably used. Suitable anionically substituted polysaccharides are, for example, carboxymethylcellulose, carboxymethyl starch, oxidized starch, oxidized cellulose and other oxidized polysaccharides, and the corresponding derivatives of the freely degraded polysaccharides. Suitable water-soluble anionic copolymers are, for example, copolymers of acrylic acid with vinyl acetate, acrylic acid with ethylene, acrylic acid with acrylamide, acrylamidopropanesulfonic acid with acrylamide or acrylic acid with styrene.

It is also possible to use nonionic or betainic protective colloids. An overview of customarily used protective colloids is given in Houben Weyl, Methoden der organischen Chemie, volume XIV/1, Makromolekulare Stoffe, Georg Thieme Verlag, Stuttgart, 1961, pages 411 to 420.

For the preparation of dispersions of hydrophilic nanoparticles, polymers which contain only monomers a), c) and optionally b) can be dispersed in water at a pH below 11. In this connection, it is often advantageous to use nonionic emulsifiers or protective colloids. Preference is given to using polymers which contain at least one monomer d) in copolymerized form, and/or emulsifying the polymers with at least one anionic emulsifier and/or stabilizing the dispersion with at least one anionic protective colloid.

To stabilize hydrophilic nanoparticles which contain anionic groups and are to be used according to the invention, further polymers can additionally be added during the dispersion. Such polymers are, for example, polysaccharides, polyvinyl alcohols and polyacrylamides.

Hydrophilic nanoparticles can also be prepared by emulsifying a melt of the hydrophilic polymers in a controlled manner. For this, the polymer or a mixture of the polymer with other additives is, for example, melted, and under the action of shear forces, e.g. in an Ultra-Turrax, water is metered in in an excess such that the pH of the initial charge is lower by at least 1 than the equivalent pH of the polymer. Here, it may in some instances be necessary to add emulsifying auxiliaries, pH regulators and/or salts. With this variant of the preparation of finely divided polymer dispersions, it is also possible to co-use additional polymers such as polysaccharides, polyvinyl alcohols or polyacrylamides, particularly if the hydrophilic polymer contains anionic groups.

The cationically modified, hydrophilic nanoparticles to be used according to the invention are obtainable by coating the surface of the hydrophilic nanoparticles with cationic polymers, polyvalent metal ions and/or cationic surfactants.

During the treatment of anionically adjusted dispersions of the hydrophilic nanoparticles with an aqueous solution of a cationic polymer, the charge of the originally anionic dispersed particles is changed, so that they have, preferably, a cationic charge after the treatment. Thus, for example, cationically modified dispersions of particulate hydrophilic nanoparticles in 0.1% strength by weight aqueous dispersion at pH 4 have an interface potential of −5 to +50 mV, preferably from −2 to +25 mV, in particular from 0 to +15 mV. The interface potential is determined by measuring the electrophoretic mobility in dilute aqueous dispersion at the pH of the intended use liquor.

Cationic polymers which may be used are all natural or synthetic cationic polymers which contain amino and/or ammonium groups and are water-soluble. Examples of such cationic polymers are polymers containing vinylamine units, polymers containing vinylimidazole units, polymers containing quaternary vinylimidazole units, condensates of imidazole and epichlorohydrin, crosslinked polyamidoamines, crosslinked polyamidoamines grafted with ethyleneimine, polyethyleneimines, alkoxylated polyethyleneimines, crosslinked polyethyleneimines, amidated polyethyleneimines, alkylated polyethyleneimines, polyamines, amine-cpichlorohydrin polycondensates, alkoxylated polyamines, polyallylamines, polydimethyldiallylammonium chlorides, polymers containing basic (meth) acrylamide or (meth)acrylic ester units, polymers containing basic quaternary (meth)acrylamide or (meth)acrylic ester units, and/or lysine condensates.

Cationic polymers are also understood as meaning amphoteric polymers which have a net cationic charge, i.e. the polymers contain both anionic and also cationic monomers in copolymerized form, but the molar proportion of the cationic units present in the polymer is greater than that of the anionic units.

For the preparation of polymers containing vinylamine units, the starting materials are, for example, open-chain N-vinylcarboxamides of the formula (I)

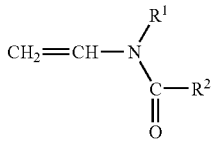

(I)

in which R' and $R^2$ may be identical or different and are hydrogen and $C_1$- to $C_6$-alkyl. Suitable monomers are, for example, N-vinylformamide ($R^1$=$R^2$=H in formula 1) N-vinyl-N-methylformamide, N-vinylacetamide, N-vinyl-N-methylacetamide, N-vinyl-N-ethylacetamide, N-vinyl-N-methylpropionamide and N-vinylpropionamide. To prepare the polymers, said monomers can either be polymerized on their own, in a mixture with one another or together with other monoethylenically unsaturated monomers. Preference is given to starting from homo- or copolymers of N-vinylformamide. Polymers containing vinylamine units are known, for example, from U.S. Pat. No. 4,421,602, EP-A-0 216 387 and EP-A-0 251 182. They are obtained by hydrolysis of polymers which contain the monomers of the formula I in copolymerized form with acids, bases or enzymes.

Suitable monoethylenically unsaturated monomers which are copolymerized with the N-vinylcarboxamides are all compounds copolymerizable therewith. Examples thereof are vinyl esters of saturated carboxylic acids having 1 to 6 carbon atoms, such as vinyl formate, vinyl acetate, vinyl propionate and vinyl butyrate, and vinyl ethers, such as $C_1$- to $C_6$-alkyl vinyl ethers, e.g. methyl or ethyl vinyl ether. Further suitable comonomers are ethylenically unsaturated $C_3$ to $C_6$-carboxylic acids, for example acrylic acid, methacrylic acid, maleic acid, crotonic acid, itaconic acid and vinyl acetic acid, and the alkali metal and alkaline earth metal salts thereof, esters, amides and nitrites of said carboxylic acids, for example methyl acrylate, methyl methacrylate, ethyl acrylate and ethyl methacrylate.

Further suitable monoethylenically unsaturated monomers which are copolymerized with the N-vinylcarboxamides are carboxylic esters derived from glycols or polyalkylene glycols, where in each case only one OH group is esterified, e.g. hydroxyethyl acrylate, hydroxyethyl methacrylate, hydroxypropyl acrylate, hydroxybutyl acrylate, hydroxypropyl methacrylate, hydroxybutyl methacrylate and acrylic monoesters of polyalkylene glycols of molar mass from 500 to 10 000. Further suitable comonomers are esters of ethylenically unsaturated carboxylic acids with amino alcohols, such as dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. The basic acrylates can be used in the form of the free bases, the salts with mineral acids, such as hydrochloric acid, sulfuric acid or nitric acid, the salts with organic acids, such as formic acid, acetic acid, propionic acid, or the sulfonic acids, or in quaternized form. Suitable quaternizing agents are, for example, dimethyl sulfate, diethyl sulfate, methyl chloride, ethyl chloride or benzyl chloride.

Further suitable comonomers are amides of ethylenically unsaturated carboxylic acids, such as acrylamide, methacrylamide, and N-alkylmono- and diamides of monoethylenically unsaturated carboxylic acids having alkyl radicals of from 1 to 6 carbon atoms, e.g. N-methylacrylamide, N,N-dimethylacrylamide, N-methylmethacrylamide, N-ethylacrylamide, N-propylacrylamide and tert-butylacrylamide, and basic (meth)acrylamides, such as, for example, dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Also suitable as comonomers are N-vinylpyrrolidone, N-vinylcaprolactam, acrylonitrile, methacrylonitrile, N-vinylimidazole, and substituted N-vinylimidazoles, such as, for example, N-vinyl-2-methylimidazole, N-vinylmethylimidazole, N-vinyl-5 methylimidazole, N-vinyl-2-ethylimidazole and N-vinylimidazolines, such as N-vinylimidazoline, N-vinyl-2-methylimidazoline and N-vinyl-2 ethylimidazoline. Apart from being used in the form of the free bases, N-vinylimidazoles and N-vinylimidazolines can also be used in a form neutralized with mineral acids or organic acids or in quaternized form, the quaternization preferably being effected using dimethyl sulfate, diethyl sulfate, methyl chloride or benzyl chloride. Also suitable are diallyldialkylammonium halides, such as, for example, diallyldimethylammonium chlorides.

Further suitable comonomers arc monomers containing sulfo groups, such as, for example, vinylsulfonic acid, allylsulfonic acid, methallylsulfonic acid, styrenesulfonic acid, the alkali metal or ammonium salts of these acids or 3 sulfopropyl acrylate, where the content of cationic units in the amphoteric copolymers exceeds the content of anionic units, meaning that the polymers have a cationic charge overall.

The copolymers comprise, for example, 99.99 to 1 mol %, preferably 99.9 to 5 mol %, of N-vinylcarboxamides of the formula I and 0.01 to 99 mol %, preferably 0.1 to 95 mol %, of other monoethylenically unsaturated monomers copolymerizable therewith in copolyrnerized form.

To prepare polymers containing vinylamine units, preference is given to starting from homopolymers of N-vinylformamide or of copolymers obtainable by copolymerization of N-vinylformamide with vinyl formate, vinyl acetate, vinyl propionate, acrylonitrile, N-vinylcaprolactam, N-vinylurea, acrylic acid, N-vinylpyrrolidone or $C_1$- to $C_6$-alkyl vinyl ethers and subsequent hydrolysis of the homopolymers or of the copolymers with the formation of vinylamine units from the copolymerized N-vinylformamide units, the degree of hydrolysis being, for example, 0.1 to 100 mol %.

The hydrolysis of the above-described polymers is carried out in accordance with known processes by the action of acids, bases or enzymes. In this process, the copolymerized monomers of the above formula (I) produce, as a result of cleaving off the group

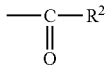

(II)

where R2 has the meaning given therefor in formula I, polymers which contain vinylamine units of the formula (III)

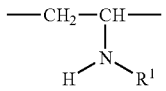

(III)

in which $R^1$ has the meaning given in formula I. If acids are used as hydrolysis agents, the units (II) are in the form of the ammonium salt.

The homopolymers of the N-vinylcarboxamides of the formula (I) and their copolymers can be hydrolyzed to 0.1 to 100 mol %, preferably 70 to 100 mol %. In most cases, the degree of hydrolysis of the homopolymers and copolymers is 5 to 95 mol %. The degree of hydrolysis of the homopolymers is synonymous with the content of vinylamine units in the polymers. In the case of copolymers which contain vinyl esters in copolymerized form, in addition to the hydrolysis of the N-vinylformamide units, hydrolysis of the ester groups can arise with the formation of vinyl alcohol units. This is the case particularly when the hydrolysis of the copolymers is carried out in the presence of sodium hydroxide solution. Copolymerized acrylonitrile is likewise chemically changed during the hydrolysis. Here, amide groups or carboxyl groups, for example, form. The homopolymers and copolymers containing vinylamine units may optionally contain up to 20 mol % of amidine units, which is formed, for example, by the reaction of formic acid with two adjacent amino groups or by intramolecular reaction of an amino group with an adjacent amide group e.g. of copolymerized N-vinylformamide. The molar masses of the polymers containing vinylamine units are, for example, 1 000 to 10 million, preferably 10 000 to 5 million (determined by light scattering). This molar mass range corresponds, for example, to K values of from 5 to 300, preferably 10 to 250 (determined in accordance with H. Fikentscher in 5% strength aqueous sodium chloride solution at 25° C. and a polymer concentration of 0.5% by weight).

The polymers containing vinylamine units are preferably used in salt-free form. Salt-free aqueous solutions of polymers containing vinylamine units can be prepared, for example, from the above-described salt-containing polymer solutions using ultrafiltration over suitable membranes at cut-offs of, for example, 1 000 to 500 000 daltons, preferably 10 000 to 300 000 daltons. The aqueous solutions of other polymers containing amino and/or ammonium groups described below can also be obtained in salt-free form by means of ultrafiltration.

Further suitable cationic polymers are polyethyleneimines. Polyethyleneimines are prepared, for example, by polymerization of ethyleneimine in aqueous solution in the presence of acid-eliminating compounds, acids or Lewis acids. Polyethyleneimines have, for example, molar masses up to 2 million, preferably from 200 to 500 000. Particular preference is given to using polyethyleneimines having molar masses of from 500 to 100 000. Also suitable are water-soluble, crosslinked polyethyleneimines which are obtainable by reacting polyethyleneimines with crosslinkers, such as epichlorohydrin or bischlorohydrin ethers of polyalkylene glycols having 2 to 100 ethylene oxide and/or propylene oxide units. Amidic polyethyleneimines which are obtainable, for example, by amidation of polyethyleneimines with $C_1$- to $C_2$-monocarboxylic acids are also suitable. Further suitable cationic polymers are alkylated polyethyleneimines and alkoxylated polyethyleneimines. During the alkoxylation, 1 to 5 ethylene oxide or propylene oxide units are used, for example, per NH unit in polyethyleneimine.

Further suitable amino- and/or ammonium-containing polymers are polyamidoamines, which are obtainable, for example, by condensing dicarboxylic acids with polyamines. Suitable polyamidoamines are obtained, for example, by reacting dicarboxylic acids having 4 to 10 carbon atoms with polyalkylenepolyamines which contain 3 to 10 basic nitrogen atoms in the molecule. Suitable dicarboxylic acids are, for example, succinic acid, maleic acid, adipic acid, glutaric acid, suberic acid, sebacic acid and terephthalic acid. In the preparation of the polyamidoamines it is also possible to use mixtures of dicarboxylic acids as well as mixtures of two or more polyalkylenepolyamines. Examples of suitable polyalkylenepolyamines are diethylenetriamine, triethylenetetramine, tetraethylenepentamine, dipropylenetriamine, tripropylenetetramine, dihexamethylenetriamine, aminopropylethylenediamine and bisaminopropylethylenediamine. For the preparation of the polyamido amines, the dicarboxylic acids and polyalkylenepolyamines are heated to relatively high temperatures, e.g. to temperatures in the range from 120 to 220, preferably 130 to 180° C. The water which forms during the condensation is removed from the system. Lactones or lactams of carboxylic acids having 4 to 8 carbon atoms may also be used in the condensation. 0.8 to 1.4 mol of a polyalkylenepolyamine, for example, are used per mole of dicarboxylic acid.

Further amino-containing polymers arc polyamidoamines grafted with ethyleneimine. They are obtainable from the above-described polyamidoamines by reaction with ethyleneimine in the presence of acids or Lewis acids, such as sulfuric acid or boron trifluoride etherates, at temperatures of, for example, 80 to 100° C. Compounds of this type are described, for example, in DE-B-24 34 816.

The optionally crosslinked polyamidoamines, which have optionally been additionally grafted with ethyleneimine prior to crosslinking, are also suitable as cationic polymers. The crosslinked polyamidoamines grafted with ethyleneimine are water-soluble and have, for example, an average molecular weight of from 3 000 to 1 million daltons. Customary crosslinkers are, for example, epichlorohydrin or biscblorohydrin ethers of alkylene glycols and polyalkylene glycols.

Further examples of cationic polymers which contain amino and/or ammonium groups are polydiallyldimethylammonium chlorides. Polymers of this type are likewise known.

Further suitable cationic polymers are copolymers of, for example, 1 to 99 mol %, preferably 30 to 70 mol % of acrylamide and/or methacrylamide and 99 to 1 mol %, preferably 70 to 30 mol % of cationic monomers, such as dialkylaminoalkylacrylamide, dialkylaminoalkylacrylic esters and/or dialkylaminoalkylmethacrylamide and/or dialkylaminoalkylmethacrylic esters. The basic acrylamides and methacrylamides are likewise preferably in a form neutralized with acids or in quaternized form. Examples which may be mentioned are N-trimethylammoniumethylacrylamide chloride,
N-trimethylammoniumethylmethacrylamide chloride,
N-trimethylammoniumethyl methacrylate chloride,
N-trimethylammoniumethyl acrylate chloride,
trimethylammoniumethylacrylamide methosulfate,
trimethylammoniumethylmethacrylamide methosulfate,
N-ethyldimethylammoniumethylacrylamide ethosulfate,
N-ethyldimethylammoniumethylmethacrylamide ethosulfate,
trimethylammoniumpropylacrylamide chloride,
trimethylammoniumpropylmethacrylamide chloride,
trimethylammoniumpropylacrylamide methosulfate,
trimethylammoniumpropylmethacrylamide methosulfate and
N-ethyldimethylammoniumpropylacrylamide ethosulfate.

Preference is given to trimethylammoniumpropylmethacrylamide chloride.

Further suitable cationic monomers for the preparation of (meth)acrylamide polymers are diallyldimethylammonium halides and basic (meth)acrylates. Suitable examples are copolymers of 1 to 99 mol %, preferably 30 to 70 mol %, of acrylamide and/or methacrylamide and 99 to 1 mol %, preferably 70 to 30 mol %, of dialkylaminoalkyl acrylates and/or methacrylates, such as copolymers of acrylamide and N,N-dimethylaminoethyl acrylate or copolymers of acrylamide and dimethylaminopropyl acrylate. Basic acrylates or methacrylates are preferably in a form neutralized with acids or in quaternized form. The quaternization can be carried out, for example, with methyl chloride or with dimethyl sulfate.

Further suitable cationic polymers which have amino and/or ammonium groups are polyallylamines. Polymers of this type are obtained by homopolymerization of allylamine, preferably in a form neutralized with acids or in quaternized form, or by a copolymerization of allylamine with other monoethylenically unsaturated monomers which are described above as comonomers for N-vinylcarboxamides.

The cationic polymers have, for example, K values of from 8 to 300, preferably 100 to 180 (determined in accordance with H. Fikentscher in 5% strength by weight aqueous sodium chloride solution at 25° C. and a polymer concentration of 0.5% by weight). At a pH of 4.5, they have, for example, a charge density of at least 1, preferably at least 4 meq/g of polyelectrolyte.

Examples of preferred cationic polymers are polydimethyldiallylammonium chloride, polyethyleneimine, polymers containing vinylamine units, copolymers of acrylamide or methacrylamide, containing basic monomers in copolymerized form, polymers containing lysine units, or mixtures thereof. Examples of cationic polymers are:

copolymers of 50% vinylpyrrolidone and 50% trimethylammoniumethyl methacrylate methosulfate, $M_w$ 1 000 to 500 000;

copolymers of 30% acrylamide and 70% trimethylammoniumethyl methacrylate methosulfate, $M_w$ 1 000 to 1 000 000;

copolymers of 70% acrylamide and 30% dimethylarninoethyl methacrylamide, $M_w$ 1 000 to 1 000 000;

copolymers of 50% hydroxyethyl methacrylate and 50% 2-dimethylaminoethyl methacrylamide, $M_w$ 1000 to 500 000;

copolymer of 70% hydroxyethyl methacrylate and 50% 2-dimethylaminoethylmethacrylamide; copolymer of 30% vinylimidazole methochloride, 50% dimethylaminoethyl acrylate, 15% acrylamide, 5% acrylic acid;

polylysines having an $M_w$ of from 250 to 250 000, preferably 500 to 100 000, and lysine cocondensates having molar masses $M_w$ of from 250 to 250 000, the cocondensible component being, for example, amines, polyamines, ketene dimers, lactams, alcohols, alkoxylated amines, alkoxylated alcohols and/or nonproteinogenic amino acids, vinylamine homopolymers, 1 to 99% of hydrolyzed polyvinyl-formamides, copolymers of vinylformamide and vinyl acetate, vinyl alcohol, vinylpyrrolidone or acrylamide having molar masses of from 3 000–500 000, vinylimidazole homopolymers, vinylimidazole copolymers with vinylpyrrolidone, vinylformarnide, acrylamide or vinyl acetate having molar masses of from 5 000 to 500 000, and quaternary derivatives thereof, polyethyleneimines, crosslinked polyethyleneimines or amidated polyethyleneimines having molar masses of from 500 to 3 000 000, amine/epichlorohydrin polycondensates which contain, as amine component, imidazole, piperazine, $C_1$–$C_8$-galkylamines, $C_1$–$C_8$-dialkylamines and/or dimethylaminopropylamine and which have a molar mass of from 500 to 250 000, polymers containing basic (meth)acrylamide or (meth) acrylic ester units, polymers containing basic quaternary (meth)acrylamide or (meth)acrylic ester units and having molar masses of from 10 000 to 2 000 000.

Futhermore, it is also possible to incorporate a minor amount (<10% by weight) of anionic comonomers by polymerization, e.g. acrylic acid methacrylic acid, vinylsulfonic acid or alkali metal salts of said acids.

In order to cationically modify hydrophilic nanoparticles, they can also be treated with polyvalent metal ions and/or cationic surfactants. Coating of the particles with polyvalent metal ions is achieved by, for example, adding an aqueous solution of at least one watersolublc, polyvalent metal salt to an aqueous dispersion of anionically dispersed hydrophilic nanoparticles, or dissolving a water-soluble, polyvalent metal salt therein, the modification of the anionically dispersed hydrophilic nanoparticles with cationic polymers being carried out either before, at the same time as or after this treatment. Suitable metal salts are, for example, the water-soluble salts of Ca, Mg, Ba, Al, Zn, Fe, Cr or mixtures thereof. Other water-soluble heavy metal salts which are derived, for example, from Cu, Ni, Co and Mn can also in principle be used, but are not desired in all applications. Examples of water-soluble metal salts are calcium chloride, calcium acetate, magnesium chloride, aluminum sulfate, aluminum chloride, barium chloride, zinc chloride, zinc sulfate, zinc acetate, iron(II) sulfate, iron(III) chloride, chromium(III) sulfate, copper sulfate, nickel sulfate, cobalt sulfate and manganese sulfate. Preference is given to using the water-soluble salts of Ca, Al and Zn for the cationic modification.

The charge of the hydrophilic nanoparticles can also be changed using cationic surfactants. Of potential suitability for this purpose are cationic surfactants of varying structures. An overview of a selection of suitable cationic surfactants is given in Ullmans Enzyklopadie Industriellen Chemie [Ullmanns Encyclopaedia of Industrial Chemistry], Sixth Edition, 1999, Electronic Release, Chapter "Surfactants", Chapter 8, Cationic Surfactants.

Particularly suitable cationic surfactants are, for example $C_7$- to $C_{25}$-alkylamines, $C_7$- to $C_{25}$-N,N-dimethyl-N-(hydroxyalkyl)ammonium salts mono- and di-($C_7$–$C_{25}$) alkyldimethyl-ammonium compounds quaternized with alkylating agents, ester quats, such as quaternary esterified mono-, di- or trialkanolamines which have been esterified with $C_8$- to $C_{22}$-carboxylic acids, imidazoline quats, such as 1-alkylimidazolinium salts of the formulae

IV

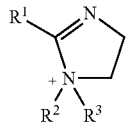

V

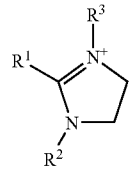

where $R^1$=$C_1$–$C_{25}$-alkyl or $C_2$–$C_{25}$-alkenyl, $R^2$=$C_1$–$C_4$-alkyl or hydroxyalkyl and $R^3$=$C_1$–$C_4$-alkyl, hydroxyalkyl or an $R_1$-(C═O)—X—$(CH_2)_n$— where X=O or NH and n=2 or 3, and where at least one radical $R^1$=$C_7$–$C_{22}$-alkyl.

For many commercial applications and everyday domestic applications, the soil release modification of textiles, textile surfaces, leather, wood, smooth and structured hard surfaces is of importance. For example, suitable surfaces of textile and nontextile materials to be treated according to the invention are microscopic hard surfaces, floor coverings and wall coverings, glass surfaces, ceramic surfaces, stone surfaces, concrete surfaces, metal surfaces, enameled surfaces, plastic surfaces, wood surfaces, surfaces of coated woods or painted surfaces. Suitable microscopic surfaces are, for example, the surfaces of porous bodies, such as foams, woods, leather, porous construction materials and, porous minerals. Other suitable surfaces are floor or wall paints or coatings and cellulose fleeces. It is not always possible to carry out the modification of the surfaces by impregnation and coating processes with concentrated formulations. It is often desirable to carry out the modification by means of a rinsing of the material to be treated with a heavily diluted liquor containing the active substance, or to achieve the modification by spraying on a heavily diluted aqueous formulation. In this connection, it is often advantageous to combine the modification of the surfaces of the materials to be treated with a washing, cleaning and/or care or impregnation of the surface.

Suitable textile materials are all types of fiber fabrics, coverings and coatings, it being possible to treat both synthetic fibers and also natural fibers and modified natural fibers. Of particular suitability are textiles of cotton fabric, modified cotton, such as, for example, viscose, cotton blend, such as, for example, cotton/polyester blend and cotton/polyamide blend and textiles made of finished fabrics or fibers. Other types of preferably treated textile surfaces are, for example, carpets, furniture covers and decorations.

Further surfaces to be treated with preference with nanoparticles according to the invention are all types of smooth and rough leathers. Of particular interest is the soil rcpellant modification of rough leather surfaces (e.g. made of suede) of leather clothing, shoes and furniture.

Further surfaces to be treated preferably with nanoparticles according to the invention are floor coverings made of plastics, such as, for example, linoleum or PVC.

The modification of the surfaces of the abovementioned materials consists primarily in a soil repellant action as the result of the treatment with the cationically modified hydrophilic nanoparticles according to the invention. This means easier soil release during a subsequent washing, rinsing or cleaning operation. However, further effects can arise as well, such as, for example, a reduction in soil adhesion, protection against chemical or mechanical influences or damage, improvement in the structural retention of fibers, improvement in the shape and structural retention of fabrics, a reduction in static charging, and an improvement in the feel.

The concentration of the hydrophilic nanoparticles during use in a rinse or care bath, in the laundry detergent liquor or in the cleaning bath is generally 0.0002 to 1.0% by weight, preferably 0.0005 to 0.25% by weight, particularly preferably 0.002 to 0.05% by weight.

Treatment of the respective surfaces is carried out with cationically modified hydrophilic nanoparticles according to the invention from aqueous liquors or rinse or spray formulations which comprise, for example, 2.5 to 300 ppm, preferably 5 to 200 ppm and in particular 10 to 100 ppm of one or more cationic polymers and/or 1 to 6 mmol/l, preferably 1.5 to 4 mmol/l of one or more water-soluble salts of divalent metals, in particular salts of Ca, Mg or Zn and/or 0.05 to 2 mmol/l, preferably 0.1 to 0.75 mmol/l of one or more water-soluble Al salts and/or 1 to 600 ppm, preferably 10 to 300 ppm, of cationic surfactants.

If cationically modified nanoparticles according to the invention are used as additive, it is possible to dispense completely or partially with the addition of further cationic polymers, polyvalent metal ions or cationic surfactants.

The rinse liquor or the formulation to be sprayed on is usually prepared by diluting concentrated formulations with water or predominantly aqueous solvents. If this dilution is carried out with water which comprises at least 1.0 mmol of Ca2+ and/or $Mg^{2+}$, preferably at least 1.5 mmol/l, particularly preferably at least 2.0 mmol/l, the treatment with dispersions of the hydrophilic nanoparticles can also be carried out without the addition of cationic polymers, polyvalent metal ions and/or cationic surfactants.

Compositions according to the invention for the treatment of surfaces which are used in dilution with water may be solid or liquid. Solid compositions may be in the form of powders, granules or tablets and, for use, are dissolved or dispersed in water, the nanoparticles according to the invention being present in disperse distribution following dilution.

The cationic modification of the hydrophilic nanoparticles is preferably carried out prior to use in the aqueous treatment compositions. It may, however, also be carried out during the preparation of the aqueous treatment compositions or during the use of non-cationically modified hydrophilic nanoparticles by, for example, mixing aqueous dispersions of the hydrophilic nanoparticles with the other constituents of the respective treatment composition in the presence of cationic polymers, water-soluble salts of polyvalent metals and/or cationic surfactants.

In a particular embodiment, the non-cationically modified nanoparticles or formulations comprising these particles can also be added directly to the rinse, wash or cleaning liquor if it is ensured that sufficient amounts of cationic polymers and/or polyvalent metal ions and/or cationic surfactants are present in the liquor in dissolved form. For example, it is possible to use the non-cationically modified hydrophilic nanoparticles or formulations comprising these particles in liquors with a content of cationic polymers of from 2.5 to 300 ppm, of water-soluble salts of Ca, Mg or Zn of more than 0.5 mmol/l, preferably more than 1.0 mmol/l, particularly preferably more than 2.0 mmol/l. If cationic surfactants are used, they are used, for example, in concentrations of from 50 to 1 000 ppm, preferably 75to 500 ppm and in particular from 100 to 300 ppm, in the aqueous liquor.

The hydrophilic, non-cationically modified nanoparticles or formulations comprising these nanoparticles can also be added to the wash liquor before, after or at the same time as a formulation comprising cationic polymers, polyvalent metal ions and/or cationic surfactants.

The present invention also provides a composition for the soil release treatment of surfaces of textile or nontextile materials, comprising:

a) 0.05 to 40% by weight of hydrophilic nanoparticles, b) 0 to 30% by weight of one or more cationic polymers, cationic surfactants and/or water-soluble salts of Mg, Ca, Zn or Al, c) 0 to 20% by weight of acid, d) 0 to 80% by weight of customary additives, such as bases, inorganic builders, organic cobuilders, further surfactants, polymeric color transfer inhibitors, polymeric antiredeposition agents, further soil release polymers different from a), enzymes, complexing agents, corrosion inhibitors, waxes, silicone oils, light protection agents, dyes, nonaqueous solvents, extenders, hydrotropic agents, thickeners and/or alkanolarnines, and e) 0 to 99.95% by weight of water.

In are embodiment, the compositions according to the invention comprise 0.01 to 10% by weight of acid. In another embodiment, the compositions according to the invention comprise 0.01 to 40% by weight of customary additives. In a further embodiment, the compositions according to the invention comprise 50 to 95% by weight of water.

Compositions according to the invention for the treatment of surfaces which are used in dilution with water can, for example, have the following composition:

(a) 0.1 to 40% by weight of hydrophilic nanoparticles (c) 0 to 20% by weight of acid, and (d) 0.01 to 80% by weight of customary additives, such as acids, bases, inorganic builders, organic cobuilders, surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, nonaqueous solvents, hydrotropic agents, thickeners and/or alkanolamines.

Preferred compositions according to the invention for the treatment of surfaces to be used in dilution with water have the following composition:

(a) 0.1 to 40% by weight of hydrophilic nanoparticles, (b) 0.1 to 30% by weight of cationic polymers and/or water-soluble salts of Mg, Ca, Zn or Al and/or cationic surfactants, (c) 0 to 20% by weight of acid, and (d) 0 to 80% by weight of customary additives, such as bases, inorganic builders, organic cobuilders, surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, nonaqueous solvents, hydrotropic agents, thickeners and/or alkanolamines.

Further preferred compositions according to the invention for the treatment of surfaces which are used in dilution with water have the following composition:

(a) 0.1 to 40% by weight of hydrophilic nanoparticles, (b) 0.1 to 10% by weight of acid, and (d) 0 to 80% by weight of customary additives, such as bases, inorganic builders, organic cobuilders, surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, nonaqueous solvents, hydrotropic agents, thickeners and/or alkanolamines.

Particularly preferred compositions according to the invention for the treatment of surfaces which are used in dilution with water have the following composition:

(a) 0.1 to 40% by weight of hydrophilic nanoparticles, (b) 0.01 to 30% by weight of cationic polymers, water-soluble salts of Mg, Ca, Zn or Al and/or cationic surfactants (c) 0.1 to 10% by weight of acid, and (d) 0.01 to 80% by weight of customary additives, such as bases, inorganic builders, organic cobuilders, further surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, nonaqueous solvents, hydrotropic agents, thickeners and/or alkanolamines.

Liquid compositions are in the form of dispersions, where the dispersions may also be completely transparent if very small nanoparticles according to the invention are used or their concentration is very low. Liquid compositions according to the invention have a pH below 10, preferably below 8, particularly preferably below 6.5, in particular below 4.5.

Liquid compositions for the soil release treatment of surfaces which are used in dilution with water can also have the following composition:

(a) 0.1 to 40% by weight of hydrophilic nanoparticles, (c) 0.1 to 10% by weight of acid, (d) 0.01 to 40% by weight of customary additives, such as bases, inorganic builders, organic cobuilders, surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, nonaqueous solvents, hydrotropic agents, thickeners and/or alkanolamines, and (e) 50–95% by weight of water where the pH of the composition is from 1 to 10.

Preferred liquid compositions for the soil release treatment of surfaces which are used in dilution with water can also have the following composition:

(a) 0.1 to 40% by weight of hydrophilic nanoparticles, (b) 0.01 to 30% by weight of cationic polymers, water-soluble salts of Mg, Ca, Zn or Al and/or cationic surfactants, (c) 0.1 to 10% by weight of acid, (d) 0.01 to 40% by weight of customary additives, such as bases, inorganic builders, organic cobuilders, surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, nonaqueous solvents, hydrotropic agents, thickeners and/or alkanolamines, and (e) 50–95% by weight of water where the pH of the composition is from 1 to 10.

In the formulations described above, the component (b) can, for example, have the following composition:

(b1) 0.01 to 10% by weight of cationic polymers and/or (b2) 0.01 to 30% by weight of water-soluble salts of Mg, Ca, Zn or Al and/or (b3) 0.01 to 30% by weight of cationic surfactants, in each case based on the total weight of the composition, where the sum of (b1) to (b3) is at most 30% by weight.

Suitable acids (c) are mineral acids, such as sulfuric acid, hydrochloric acid or phosphoric acid, or organic acids, such as carboxylic acids or sulfonic acids, strong mineral acids and sulfonic acids being used either dilute in a small amount below 5% by weight or as partially neutralized acidic salts. Preference is given to using $C_1$–$C_3$-monocarboxylic acids, $C_2$–$C_8$-dicarboxylic acids and $C_6$–$C_{18}$ -tricarboxylic acids. In particular, formic acid, acetic acid, lactic acid, oxalic acid, succinic acid, $C_3$–$C_{14}$-alkylsuccinic acid, $C_3$–$C_{14}$-alkenylsuccinic acids, maleic acid, adipic acid, malic acid, tartaric acid, butanetetracarboxylic acid and citric acid are used.

Soil release laundry after-treatment and laundry care compositions comprise, for example, (a) 0.1 to 30% by weight of hydrophilic nanoparticles, (b) 0.1 to 10% by weight of cationic polymers, water-soluble salts of Mg, Ca, Zn or Al and/or cationic surfactants, (c) 0.05 to 20% by weight of a carboxylic acid, such as formic acid, citric acid, adipic acid, succinic acid, oxalic acid or mixtures thereof, (d) 0 to 10% by weight of further customary ingredients, such as perfume, silicone oil, light protection agents, dyes, complexing agents, antiredeposition agents, further soil release polymers different from (a), color transfer inhibitors, nonaqueous solvents, hydrotropic agents, thickeners and/or alkanolamines and (e) 30 to 99.65% by weight of water.

Preferred soil release laundry after-treatment and laundry care compositions comprise (a) 1 to 30% by weight of hydrophilic nanoparticles, (b) 0.1 to 30% by weight of cationic polymers and/or water-soluble salts of Mg, Ca, Zn and or Al and/or cationic surfactants, (c) 1 to 15% by weight of a carboxylic acid, such as formic acid, citric acid, adipic acid, succinic acid, oxalic acid or mixtures thereof, (d) 0 to 10% by weight of further customary ingredients, such as perfume, silicone oil, light protection agents, dyes, complexing agents, antiredeposition agents, further soil release polymers different from (a), color transfer inhibitors, nonaqueous solvents, hydrotropic agents, thickeners and/or alkanolamines and (e) 15 to 97.9% by weight of water.

The component (b) can, for example, consist of (b1) 0.1 to 10% by weight of cationic polymers and/or (b2) 0.1 to 30% by weight of water-soluble salts of Mg, Ca, Zn and/or Al, where the content of water-soluble salts of aluminum is not more than 10% by weight, and/or (b3) 0.1 to 30% by weight of cationic surfactants, in each case based on the total weight of the laundry after-treatment or laundry care composition, where the sum of the components (b1) to (b3) is 0.1 to 30% by weight.

The component (b2) can, for example, consist of 0.1 to 30% by weight of water-soluble salts of Mg, Ca and/or Zn and/or 0.1 to 10% by weight of water-soluble salts of aluminum, based on the total weight of the laundry after-treatment or laundry care composition.

A further use form of the cationically modified hydrophilic nanoparticles according to the invention consists in spraying dilute aqueous formulations onto the surface to be treated. This can be carried out in the home or in commercial use by spraying using a spray bottle or an automatic spraying device. The formulations suitable for this purpose have, for example, the following compositions:

(a) 0.005 to 2% by weight of hydrophilic nanoparticles, (b) 0.0005 to 1% by weight of cationic polymers and/or water-soluble salts of Mg, Ca, Zn and/or Al and/or cationic surfactants, (c) 0 to 10% by weight of customary additives, such as bases, inorganic builders, organic cobuilders, surfactants, polymeric color transfer inhibitors, polymeric antiredeposition agents, further soil release polymers different from (a), enzymes, perfume substances, complexing agents, corrosion inhibitors, waxes, silicone oils, light protection agents, dyes, solvents, hydrotropic agents, thickeners and/or alkanolamines, and (d) 99.9945–87% by weight of water, where the pH of the composition is from 1 to 10.

Customary additives used in formulations according to the invention are the additives used in washing compositions, cleaning compositions and textile afterrinse compositions described, for example, in "Ullmanns Encyclopedia of Industrial Chemistry, Sixth Edition, 2000, Electronic Version 2.0".

In particular, suitable surfactants and cobuilders are:

anionic surfactants, in particular:

(fatty) alcohol sulfates of (fatty) alcohols having 8 to 22, preferably 10 to 18, carbon atoms, e.g. $C_9$- to $C_{11}$-alcohol sulfates, $C_{12}$- to $C_{14}$-alcohol sulfates, $C_{12}$–$C_{18}$-alcohol sulfates, lauryl sulfate, cetyl sulfate, myristyl sulfate, palmityl sulfate, stearyl sulfate and tallow fatty alcohol sulfate;

sulfated alkoxylated $C_8$- to $C_{22}$-alcohols (alkyl ether sulfates). Compounds of this type are prepared, for example, by firstly alkoxylating a $C_8$- to $C_{22}$-alcohol, preferably a $C_{10}$- to $C_{18}$-alcohol, e.g. a fatty alcohol, and then sulfating the alkoxylation product. Ethylene oxide is preferably used for the alkoxylation;

linear $C_8$- to $C_{20}$-alkylbenzenesulfonates (LAS), preferably linear $C_9$- to $C_{13}$-alkyl-benzenesulfonates and -alkyltoluenesulfonates, alkanesulfonates, such as $C_8$- to $C_{24}$-alkanesulfonates, preferably $C_{10}$- to $C_{18}$-alkanesulfonates soaps, such as, for exarnple, the Na and K salts of $C_8$- to $C_{24}$-carboxylic acids.

Said anionic surfactants are added to the washing composition preferably in the form of salts. Suitable cations in these salts are alkali metal ions, such as sodium, potassium and lithium and ammonium ions, such as hydroxyethylammonium, di(hydroxyethyl)ammonium and tri(hydroxyethyl)ammonium.

Nonionic surfactants, in particular:

alkoxylated $C_8$- to $C_{22}$-alcohols, such as fatty alcohol alkoxylates or oxo alcohol alkoxylates. These may be alkoxylated with ethylene oxide, propylene oxide and/or butylene oxide. Surfactants which rnaybe used here are all alkoxylated alcohols, which contain at least two adducted molecules of one of the abovementioned alkylene oxides. Block polymers of ethylene oxide, propylene oxide and/or butylene oxide are suitable, or addition products which contain said alkylene oxides in random distribution. The nonionic surfactants contain, per mole of alcohol, generally 2 to 50, preferably 3 to 20 mol, of at least one alkylene oxide. They preferably contain ethylene oxide as alkylene oxide. The alcohols preferably have 10 to 18 carbon atoms. Depending on the type of alkoxylation catalyst used in the preparation, the alkoxylates have a broad or narrow alkylene oxide homolog distribution;

alkylphenol alkoxylates, such as alkylphenol ethoxylates having $C_6$- to $C_{14}$-alkyl chains and 5 to 30 alkylene oxide units;

alkyl polyglucosides having 8 to 22, preferably 10 to 18, carbon atoms in the alkyl chain and generally 1 to 20, preferably 1.1 to 5, glucoside units;

N-alkylglucamides, fatty acid amide alkoxylates, fatty acid alkanolamide alkoxylates, and block copolymers of ethylene oxide, propylene oxide and/or butylene oxide.

Suitable inorganic builders are, in particular:

crystalline or amorphous alumosilicates having ion-exchanging properties, such as, in particular, zeolites. Suitable zeolites are, in particular, zeolites A, X, B, P, MAP and HS in their Na form or in forms in which Na is partially replaced by other cations such as Li, K, Ca, Mg, or ammonium;

crystalline silicates, such as, in particular, disilicates or phyllosilicates, e.g. $\delta$-$Na_2Si_2O_5$ or $\beta$-$Na_2Si_2O_5$. The silicates can be used in the form of their alkali metal, alkaline earth metal or ammonium salts, preferably as Na, Li and Mg silicates;

amorphous silicates, such as, for example, sodium metasilicate or amorphous disilicate;

carbonates and hydrogencarbonates. These can be used in the form of their alkali metal, alkaline earth metal or ammonium salts. Preference is given to Na, Li and Mg carbonates or hydrogencarbonates, in particular sodium carbonate and/or sodium hydrogencarbonate;

polyphosphates, such as, for example, pentasodium triphosphate;

Suitable organic cobuilders are, in particular, low molecular weight, oligomeric or polymeric carboxylic acids.

Suitable low molecular weight carboxylic acids are, for example, citric acid, hydrophobically modified citric acid, such as, for example, agaric acid, malic acid, tartaric acid, gluconic acid, glutaric acid, succinic acid, imidodisuccinic acid, oxydisuccinic acid, propanetricarboxylic acid, butanetetracarboxylic acid, cyclopentanetetracarboxylic acid, alkyl- and alkenylsuccinic acids and amino-polycarboxylic acids, such as, for example, nitrilotriacetic acid, $\beta$-alaninediacetic acid, ethylenediaminetetraacetic acid, serinediacetic acid, isoserinediacetic acid, N-(2-hydroxyethyl) iminodiacetic acid, ethylenediaminedisuccinic acid and methyl- and ethylglycinediacetic acid;

suitable oligomeric or polymeric carboxylic acids are, for example, homopolymers of acrylic acid, oligomaleic acids, copolymers of maleic acid with acrylic acid, methacrylic acid, $C_2$–$C_{22}$-olefins, such as, for example, isobutene or long-chain $\alpha$-olefins, vinyl alkyl ethers with $C_1$–$C_8$-alkyl groups, vinyl acetate, vinyl propionate, (meth)acrylic esters of $C_1$–$C_8$-alcohols and styrene. Preference is given to using the homopolymers of acrylic acid and copolymers of acrylic acid with maleic acid. Also suitable are polyaspartic acids as organic cobuilders. The oligomeric and polymeric carboxylic acids are used in acid form or as sodium salt.

The invention is illustrated by the examples below.

EXAMPLES

An example of typical anionic dispersions which can be processed by mixing with cationic polymers, water-soluble salts of polyvalent metals and/or cationic surfactants, and other components to give rinse, cleaning or care compositions is the dispersions described below whose dispersed particles, upon dynamic light scattering, can be observed as discrete particles with the given average particle diameter.

With the nanoparticles to be used according to the invention, a much higher soil release action is achieved particularly on cotton and cellulose fibers than with known processes.

The particle size distribution was measured using an "Autosizer 2C" from Malvern, GB. Measurement was carried out at 23° C. Unless otherwise stated, solutions are aqueous solutions.

Dispersion 55.4 g of an oxidatively degraded starch with a carboxylate degree of substitution of from 0.03 to 0.04 and a K value of 34 (determined in accordance with DIN 53726, Amylex 15from Südstärke) and 1 112 g of water are introduced into a polymerization vessel fitted with stirrer, reflux condenser, metering devices and equipment for working under a nitrogen atmosphere, and are heated with stirring over 25 minutes to a temperature of 85° C. 0.2 g of a 25% strength by weight aqueous calcium acetate solution and 10 g of a 10.5 g of a 1% strength by weight commercially available enzyme solution (alpha-amylase, Termamyl 120 L from Novo Nordisk) are then added. After 15 minutes, the enzymatic starch degradation is stopped by adding 6 g of glacial acetic acid. 2.4 g of a 10% strength by weight aqueous iron(II) sulfate solution are also added. The temperature of the reaction mixture is maintained at 85° C. At this temperature, a mixture of 3.1 g of ethyl acrylate, 132 g of methacrylic acid, 17 g of acrylic acid and 2.1 g of allyl methacrylate is then added over the course of 150 minutes. The initiator feed starts at the same time as the monomer feed. Over the course of 165 minutes, 70 g of a 15% strength by weight hydrogen peroxide solution are added. After the total amount of initiator has been added, the mixture is cooled to 50° C. As soon as the desired temperature has been reached, a 0.3 g of a 70% strength by weight tertiary-butyl hydroperoxide solution is metered in over the course of 15 minutes, and the mixture is after-stirred for 30 minutes. The mixture is then cooled to room temperature, giving a dispersion with a solids content of 14.7% by weight, an average particle diameter of the dispersed particles of 134 nm and a filtration residue of 1 g, based on the total mixture.

Washing Experiments

To test the soil release properties of afterrinse formulations containing nanoparticles according to the invention compared with afterrinse formulations of the prior art, the following washing experiments were carried out:

Example 1

The dispersion was diluted with deionized water of pH 4 to a concentration of 2 000 ppm and metered, with stirring, into the equivalent amount of a solution of 200 ppm of high molecular weight polyethyleneimine of molar mass 1 000 000 in deionized water of pH 4.

The resulting dilute dispersion was used as afterrinse liquor.

Comparative Example 1

The dispersion was diluted with deionized water of pH 4 to a concentration of 1 000 ppm and used as afterrinse liquor.

Comparative Example 2

The aqueous solution of a copolymer as in example 1 of U.S. Pat. No. 3,836,496 of methacrylic acid and ethyl acrylate in the weight ratio 66.6:33.3 was diluted to a concentration of 1 000 ppm and adjusted to a pH of 4. This solution was used as afterrinse liquor.

Example 2

The dispersion was diluted with water which contained 3.0 mmol/l of $CaCl_2$ in dissolved form and had been adjusted to a pH of 4, to a concentration of 1 000 ppm. The resulting dilute dispersion was used as afterrinse liquor.

Comparative Example 3

A solution of a copolymer with a polymer content of 1 000 ppm as in example 1 of U.S. Pat. No. 3,993,830 of methacrylic acid and ethyl acrylate in the weight ratio 66.6:33.3 was prepared in water of pH 4 which contained 3.0 mmol/l of calcium chloride in dissolved form. This solution was used as afterrinse liquor.

Example 3

33.3 g of the dispersion were diluted with 1.25 M formic acid to 50 g. 1.4 g of calcium chloride was diluted with 1.25 M formic acid to 50 g. The dispersion was mixed with the calcium chloride solution with stirring. The resulting formulation contained 5.0% by weight of hydrophilic nanoparticles and 126 mmol/l of calcium ions. For the afterrinse liquor, 16 g of the formulation were used per liter of water containing 0.5 mmol/ of calcium chloride.

Comparative Example 4

33.3 g of the dispersion from example 3 were diluted with 1.25 M formic acid to 100 g. The resulting formulation contained 5.0% of nanoparticles and no calcium ions. For the afterrinse liquor, 16 g of the formulation were used per liter of water containing 0.5 mmol/l of calcium chloride.

In separate experiments, two 2.5 g of cotton fabric or polyester/cotton (50:50) blend (test fabric) in each case were washed with 5 g of ballast fabric (equal parts of cotton and cotton/polyester blend) using Ariel Futur, rinsed with tap water and afterrinsed with the afterrinse liquors from examples 1 to 3. The test fabrics were then dried and soiled.

In a first experimental series, lipstick composition was used as soiling. It was applied using a brush and a stencil in a circle 4 cm in diameter.

In a second experimental series, spent engine oil was used as soiling. It was applied by dripping 0.3 g of the oil onto the horizontal fabric.

The reflectance of the soiled fabrics was determined prior to washing at 460 nm (in % reflectance). The fabrics were then washed again using the heavy-duty detergent (Ariel Futur). To evaluate the soil release effect, the reflectance of the soiled fabrics was measured after washing at 460 nm (in % reflectance), and the reflectance difference AR was determined from the reflectance values before and after washing. The values for both fabrics of one experiment were averaged and rounded to whole numerical values.

Washing Conditions:

Prewash:

Washing machine: Launder-0-meter

Prewash temperature: 20° C.

Prewash time: 15 min

Liquor ratio: 25

Main Wash:

Wash temperature: 40° C.

Detergent: Ariel Futur

Detergent dosing: 3.5 g/l

Wash time: 30 min

Water hardness: 3 mmol/l

Ca/Mg ratio: 3:1

Liquor ratio: 12.5

TABLE 1

Washing experiments with lipstick composition as soiling

| | Example 1 | Example 2 | Example 3 | Comparative example 1 | Comparative example 2 | Comparative example 3 | Comparative example 4 |
|---|---|---|---|---|---|---|---|
| Δ reflectance (cotton) | 42 | 45 | 45 | 31 | 31 | 33 | 33 |
| Δ reflectance (blend) | 52 | 54 | 54 | 39 | 44 | 45 | 44 |

TABLE 2

Washing experiments with dirty engine oil as soiling

| | Example 1 | Example 2 | Example 3 | Comparative example 1 | Comparative example 2 | Comparative example 3 | Comparative example 4 |
|---|---|---|---|---|---|---|---|
| Δ reflectance (cotton) | 39 | 41 | 44 | 30 | 29 | 30 | 29 |

TABLE 2-continued

| | Washing experiments with dirty engine oil as soiling | | | | | | |
|---|---|---|---|---|---|---|---|
| | Example 1 | Example 2 | Example 3 | Comparative example 1 | Comparative example 2 | Comparative example 3 | Comparative example 4 |
| Δ reflectance (blend) | 35 | 34 | 35 | 23 | 24 | 25 | 25 |

The comparison of example 1 with the comparative examples 1 and 2 shows that in the case of rinsing with nanoparticles in water in the absence of hardness ions, a good soil release action only arises if a cationic polymer is present. The dissolved acrylate copolymer as in U.S. Pat. No. 3,836,496 exhibits no effect on the cotton fabric, and only a slight effect on the cotton/polyester blend at the same use concentration.

The comparison of example 2 with the comparative example 3 shows that in the case of a rinse with nanoparticles according to the invention in water in the presence of 3 mmol/l of Ca ions, a very good soil release action arises, whereas this is not observed in the absence of Ca ions. With the dissolved polymer as in U.S. Pat. No. 3,993,830, no satisfactory effect is achieved even in the presence of 3.0 mmol of Ca ions.

The comparison of example 3 with comparative example 4 shows that if the concentration of calcium ions is lower, as arises, for example, in the tap water in regions with soft water, only the formulation according to the invention with additional calcium ions brings about a good action.

we claim:

1. A process for the soil release treatment of surfaces of textile and nontextile materials, in which cationically modified hydrophilic nanoparticles based on crosslinked polymers of (a) 60 to 99.99% by weight of one or more carboxyl-containing ethylenically unsaturated monomers or salts thereof, (b) 0 to 40% by weight of one or more water-insoluble monoethylenically unsaturated monomers, (c) 0.01 to 30% by weight of one or more polyethylenically unsaturated monomers, (d) 0 to 25% by weight of one or more sulfonic acid- and/or phosphonic acid-containing monomers or salts thereof, (e) 0 to 30% by weight of one or more water-soluble nonionic monomers are applied to the surface of the materials from an aqueous dispersion, where the dispersion of the hydrophilic nanoparticles can be stabilized with anionic, nonionic and/or betainic emulsifiers and/or protective colloids, and where the hydrophilic nanoparticles have a particle size of from 10 nm to 2 μm and have been cationically modified by coating their surface with one or more cationic polymers, one or more polyvalent metal ions and/or one or more cationic surfactants.

2. A process as claim 1, wherein the aqueous dispersion comprises 0.0002 to 1% by weight of hydrophilic nanoparticles.

3. A process as claim 1, wherein the pH of the aqueous dispersion is from 1 to 11.

4. A process as claim 1, wherein the cationic polymers are selected from the group consisting of polymers containing vinylanine units, polymers containing vinylimidazole units, polymers containing quaternary vinylimidazole units, imidazole/epichlorohydrin condensates, crosslinked polyamidoamines, crosslinked polyamidoanines grafted with ethyleneimine, polyethyleneimines, alkoxylated polyethyleneimines, crosslinked polyethyleneimines, amidated polyethyleneimines, alkylated polyethyleneimines, polyamines, amine/epichlorohydrin polycondensates, alkoxylated polyamines, polyallylamines, polydimethyldiallylammonium chlorides, polymers containing basic (meth) acrylamide or (meth)acrylic ester units, polymers containing basic quaternary (meth)acrylanide or (meth)acrylic ester units, and lysine condensates.

5. A process as claim 1, wherein the polyvalent metal cations are selected from the group consisting of $Mg^2$+, $Ca^2$+, $Ba^2$+, $Al^3$+ and Zn2+.

6. A process as claim 1, wherein the cationic surfactants are selected from the group consisting of $C_7$–$C_{25}$-alkylamine, $C_7$–$C_{25}$alkylammonium, di($C_7$–$C_{25}$) alkylammonium, $C_7$–$C_{25}$-alkyl ester quat and $C_7$–$C_{25}$-alkylimidazolinium compounds.

7. Cationically modified hydrophilic nanoparticles based on crosslinked polymers of (a) 60 to 99.99% by weight of one or more carboxyl-containing ethylenically unsaturated monomers or salts thereof, (b) 0 to 40% by weight of one or more water-insoluble monoethylenically unsaturated monomers, (c) 0.01 to 30% by weight of one or more polyethylenically unsaturated monomers, (d) 0 to 25% by weight of one or more sulfonic acid- and/or phosphonic acid-containing monomers or salts thereof, (e) 0 to 30% by weight of one or more water-soluble nonionic monomers, where the hydrophilic nanoparticles have a particle size of from 10 nm to 2 μm and have been cationically modified by coating their surface with one or more cationic polymers, one or more polyvalent metal ions and/or one or more cationic surfactants.

8. An aqueous dispersion of cationically modified hydrophilic nanoparticles based on crosslinked polymers of (a) 60 to 99.99% by weight of one or more carboxyl-containing ethylenically unsaturated monomers or salts thereof, (b) 0 to 40% by weight of one or more water-insoluble monoethylenically unsaturated monomers, (c) 0.01 to 30% by weight of one or more polyethylenically unsaturated monomers, (d) 0 to 25% by weight of one or more sulfonic acid- and/or phosphonic acid-containing monomers or salts thereof, (e) 0 to 30% by weight of one or more water-soluble nonionic monomers, where the dispersion of the hydrophilic nanoparticles can be stabilized with anionic, nonanionic and/or betainic emulsifiers and/or protective colloids, and where the hydrophilic nanoparticles have a particle size of from 10 nm to 2 μm and have been cationically modified by coating their surface with one or more cationic polymers, one or more polyvalent metal ions and/or one or more cationic surfactants.

9. An aqueous dispersion as claimed in claim 8, which comprises 0.001 to 50% by weight of hydrophilic nanoparticles.

10. A composition for the soil release treatment of surfaces of textile or nontextile materials comprising a) 0.05 to 40% by weight of hydrophilic nanoparticles, as defined in claim 7, b) 0 to 30% by weight of one or more cationic polymers, cationic surfactants and/or water-soluble salts of Mg, Ca, Zn or Al, c) 0 to 20% by weight of acid, d) 0 to 80% by weight of customary additives, such as bases, inorganic builders, organic cobuilders, further surfactants, polymeric color transfer inhibitors, polymeric antiredeposition agents, further soil release polymers different from a), enzymes, complexing agents, corrosion inhibitors, waxes, silicone oils, light protection agents, dyes, solvents, extenders, hydrotropic agents, thickeners and/or alkanolamines, e) 0 to 99.95% by weight of water.

11. A composition as claimed in claim 10, comprising b) 0.1 to 30% by weight of cationic polymers, cationic surfactants and/or water-soluble salts of Mg, Ca, Zn or Al.

12. A composition as claimed in claim 10, comprising c) 0.01 to 10% by weight of acid.

13. A composition as claimed in claim 10, comprising d) 0.01 to 40% by weight of customary additives, e) 50 to 95% by weight of water.

14. A composition as claimed in claim 11, comprising c) 0.01 to 10% by weight of acid.

15. A composition as claimed in claim 11, comprising d) 0.01 to 40% by weight of customary additives, e) 50 to 95% by weight of water.

16. A composition as claimed in claim 12, comprising d) 0.01 to 40% by weight of customary additives, e) 50 to 95% by weight of water.

* * * * *